US005390583A

United States Patent [19]

Berglund

[11] Patent Number: 5,390,583

[45] Date of Patent: Feb. 21, 1995

[54] SINGLE-ACTION RAMMER

[75] Inventor: Bengt Berglund, Karlskoga, Sweden

[73] Assignee: Bofors AB, Karlskoga, Sweden

[21] Appl. No.: 57,771

[22] Filed: May 6, 1993

[30] Foreign Application Priority Data

May 6, 1992 [SE] Sweden ..... 9201434

[51] Int. Cl.[6] ..... F41A 9/43

[52] U.S. Cl. ..... 89/47; 89/46; 89/198

[58] Field of Search ..... 89/47, 46, 45, 33.05, 89/198, 19, 20.2, 20.4

[56] References Cited

U.S. PATENT DOCUMENTS 789,885 5/1905 Schneider ..... 89/47
947,600 1/1910 Schneider ..... 89/47
4,384,509 5/1983 Hallqvist ..... 89/47
4,957,028 9/1990 Lieberum et al. ..... 89/47

FOREIGN PATENT DOCUMENTS 262858 12/1926 United Kingdom ..... 89/47

*Primary Examiner*—Stephen M. Johnson
*Attorney, Agent, or Firm*—Pollock, Vande Sande & Priddy

[57] ABSTRACT

The present invention relates to a method and apparatus for rapid loading of separate-loading ammunition in artillery guns, the shell and propellant charge being placed after one another on or in a carrier being accelerated up to a high velocity centered about the longitudinal axis of the gun barrel. Thereafter, the carrier is rapidly retarded to arrest while the shell and the propellant charge are allowed to continue in the direction of the acceleration to their respective ramming positions in the gun.

13 Claims, 3 Drawing Sheets

SINGLE-ACTION RAMMER

TECHNICAL FIELD

The present invention relates to a method and an apparatus for the rapid ramming of shells and propellant charges in medium-caliber or large-caliber artillery pieces which utilize separate loading ammunition, that is such ammunition in which the shell and the propellant are not fixedly united with one another to form a unit.

BACKGROUND OF THE INVENTION

For the tubed or barrelled artillery of the 20th century, extremely high rates of fire will be required, since the time between opening fire and up to the point in time when the opponent, after identifying and ranging of the firing gun, is ready to commence combatting this with his own artillery is becoming shorter and shorter. Within the brief space of time which is thus available from opening fire and up to the time when the firing piece must be moved to avoid being knocked out, a sufficient number of shells must, thus, have had time to be discharged in order to have sufficient effect on the target, which, for single targets, may be assumed to be between 3 and 10 rounds.

Since the primary consideration in this application is medium-caliber or large-caliber artillery pieces (in other words of a caliber from about 7.5 cm and larger), the weight of the shells will be relatively great and, at the same time there is a main weight difference between the shell and its propellant charge.

Automatically loading an artillery gun with cartridged ammunition presents no serious problem, since each cartridge is handled and rammed in the firing position of the gun as a rigid self-contained unit. Granted, the increasingly common, combustible cases nowadays employed in separate-loading ammunition impart to the propellant charges a markedly better stability than the older gun cotton propellant charges, but the combustible cases are nevertheless generally not so rigid that they can carry a shell, for which season the shell and the propellant charges must be rammed home separately without being fixedly connected to one another.

For high fixing sates, high ramming speeds are necessary. This, combined with the need for guiding both the shell and the propellant charge during the ramming operation, as well as the large weight difference between shell and propellant charge places particular requirements on how the ramming operation is executed.

SUMMARY OF THE INVENTION

According to the present invention, this problem has been solved in that shell and propellant charge are rammed in a single action from a loading tube in which shell and propellant charge (the latter preferably in the form of a combustible case) are previously arranged in sequence, and this loading tube, on commencement of the ramming operation, is accelerated towards and preferably so far into the breech opening of the gun that the loading tube enters the chamber of the gun barrel. Thereafter the loading tube is retarded so forcibly that the shell and the propellant charge are thrown into the ramming positions of the gun intended therefor. In order that the extreme weight of the shell does not load the propellant charge during the acceleration phase, the loading tube is preferably provided with a collapsible support heel or tooth which is secured in the tube and which abuts against the rear plane of the shell and is collapsed to the side as soon as the shell has passed into the gun barrel and no longer needs its support. In order that the propellant charge (which in itself is relatively light in weight) is not to be retarded by vacuum in the rear inner portion of the loading tube, substantial ventilation apertures must be disposed in the rear region of the tube. In addition; the ramming position of the gun intended for the propellant charge must be provided with a relatively collapsible locking device which prevents the propellant charge from bouncing out again from its innermost position.

For acceleration of the loading tube, a chain transmission hydraulic ram can be employed with which accelerations up to speeds of 8–10 m/sec. can be achieved without difficulty.

A further detail is the retardation of the loading tube which, thus, must take place from a relatively high velocity over a very short distance in order to impart the correct launching effect to the shell and propellant charge. For such a rapid retardation, use may, for example, be made of one or more hydraulic dampers.

Using the above-described ramming apparatus, it is thus possible to achieve a very rapid ramming even of heavy artillery pieces. Another feature of the present invention is that the loading tube must be reloaded while the originally rammed shell is discharged. This may be affected rearwardly from a magazine of one type or another, for example, a rotary revolver magazine disposed on the gun in which each chamber either contains both propellant charge and shell or alternatively only the one, in which event several chambers or several magazines must be employed.

In order to provide sufficient time for replenishing the loading tube with a new combination of propellant charge and shell, it may be appropriate to employ at least two pendulum-suspended loading tubes which, on pivot arms, are disposed such that they alternatingly may be pivoted in behind the gun to a ramming position intended therefor immediately behind the breech opening of the gun, and to a replenishment or loading position located beside the gun where the propellant charge and shell are loaded into the tube.

The loading tube may then be replenished at half the speed with which the gun itself is loaded.

As artillery piece in connection with this ramming or loading system, use may be made of an otherwise basically conventional gun with a mechanism of the screw or breech block type, in which event the closing and opening of the mechanism must, however, be controlled by machine in order to make full use of the advantages offered by the rapid ramming process.

BRIEF DESCRIPTION OF THE ACCOMPANYING DRAWINGS

The method and the apparatus according to the present invention have been defined in the appended Claims and will now be described in greater detail hereinbelow, with particular reference to the accompanying Drawings in which:

DESCRIPTION OF PREFERRED EMBODIMENT

Figure 1:
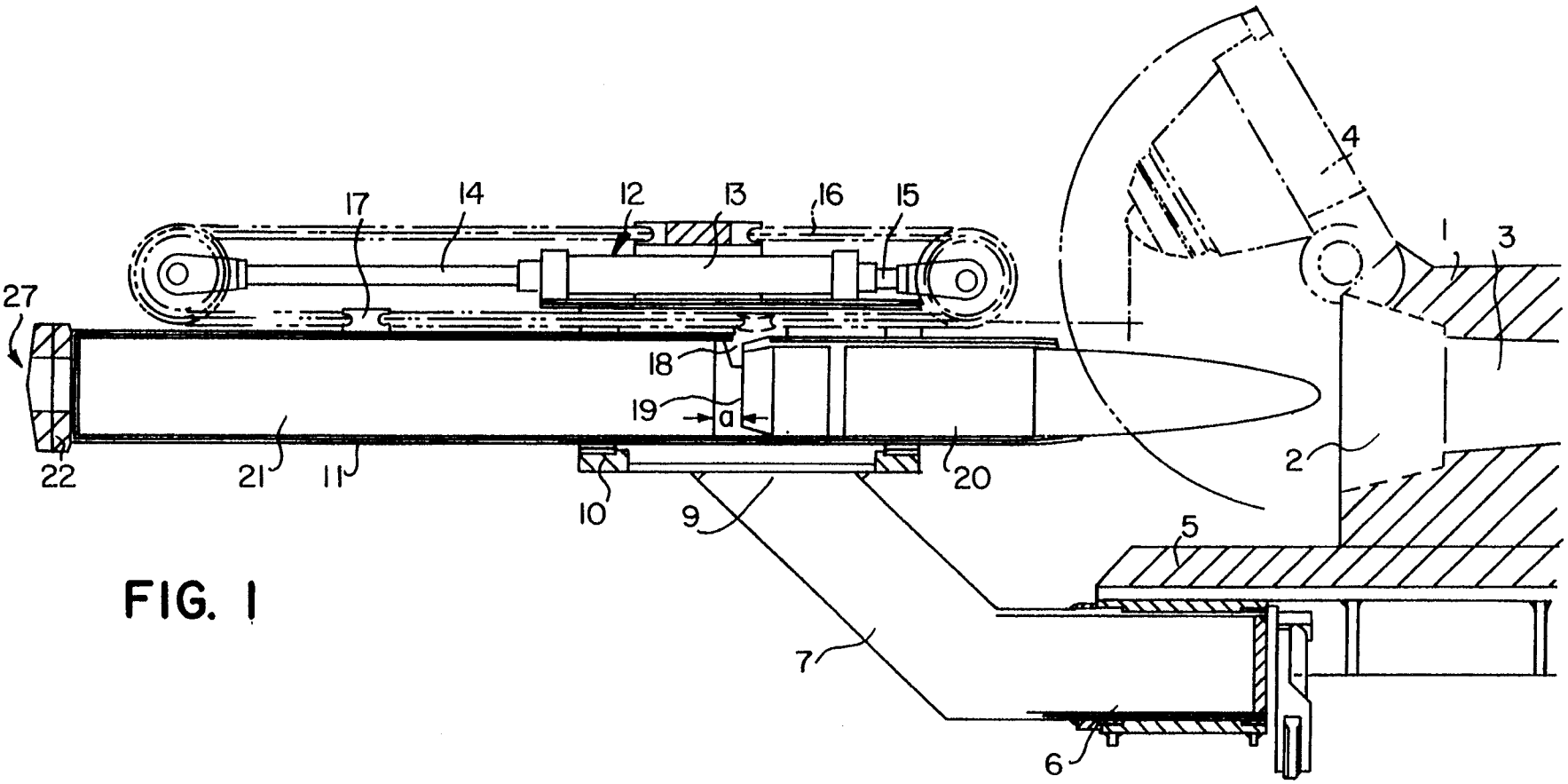
FIG. 1 is a side elevation, partially in section, of the breech opening in an artillery piece and a rammer according to the present invention disposed thereat.

All parts carry the same reference numerals throughout the drawing figures. However, for purposes of greater clarity, certain parts have only been included in individual Figures.

Shown in the Figures is the rear portion of the barrel of an artillery piece 1 provided with a breech opening 2 and a ramming position for propellant charges 3 (only a part of the ramming position is shown in FIG. 1). The ramming position for shells rammed into the gun lies to the right outside the figure. The breech opening 2 of the gun 1 may be closed using a collapsible screw lock 4. In the Figures, 5 is another part of the elevation system fixedly connected to the gun barrel 1. An angled pendulum pivot arm 7 is movably journalled at this part in a journal 6 adapted for this purpose. In its outer, free end 9, the pivot arm 7, which may be revolved by means of a hydraulic ram 8 (see FIG. 3) carries a journal 10 in which a longitudinally displaceable loading tube 11 is mounted. The loading tube 11 is longitudinally displaceable by means of a chain transmission hydraulic ram unit 12 which, in the short distance which is available (not shown in FIG. 3), can accelerate a speed of up to 10 m/sec. As will have been apparent from FIG. 1, the chain transmission hydraulic same unit consists of the hydraulic ram 13 with drive shafts 14, 15, the chain 16, an anchorage point 17 between chain and loading tube and a driving tooth 18 collapsibly secured at the chain and which, in the initial phase, abuts against the rear plane 19 of a shell 20 which lies ready for ramming. The loading tube 11 is also provided with rear buffer abutments 22 which project laterally outside the circumferential surface of the tube. On either side of the journal 10 there are disposed two hydraulic dampers 23 and 24 with their respective abutments 25 and 26. In the rear plane of the loading tube 11, there are provided one or more ventilation apertures which prevent rearward suction within the tube. The positions of the apertures are marked by the arrow 27.

Figure 2:
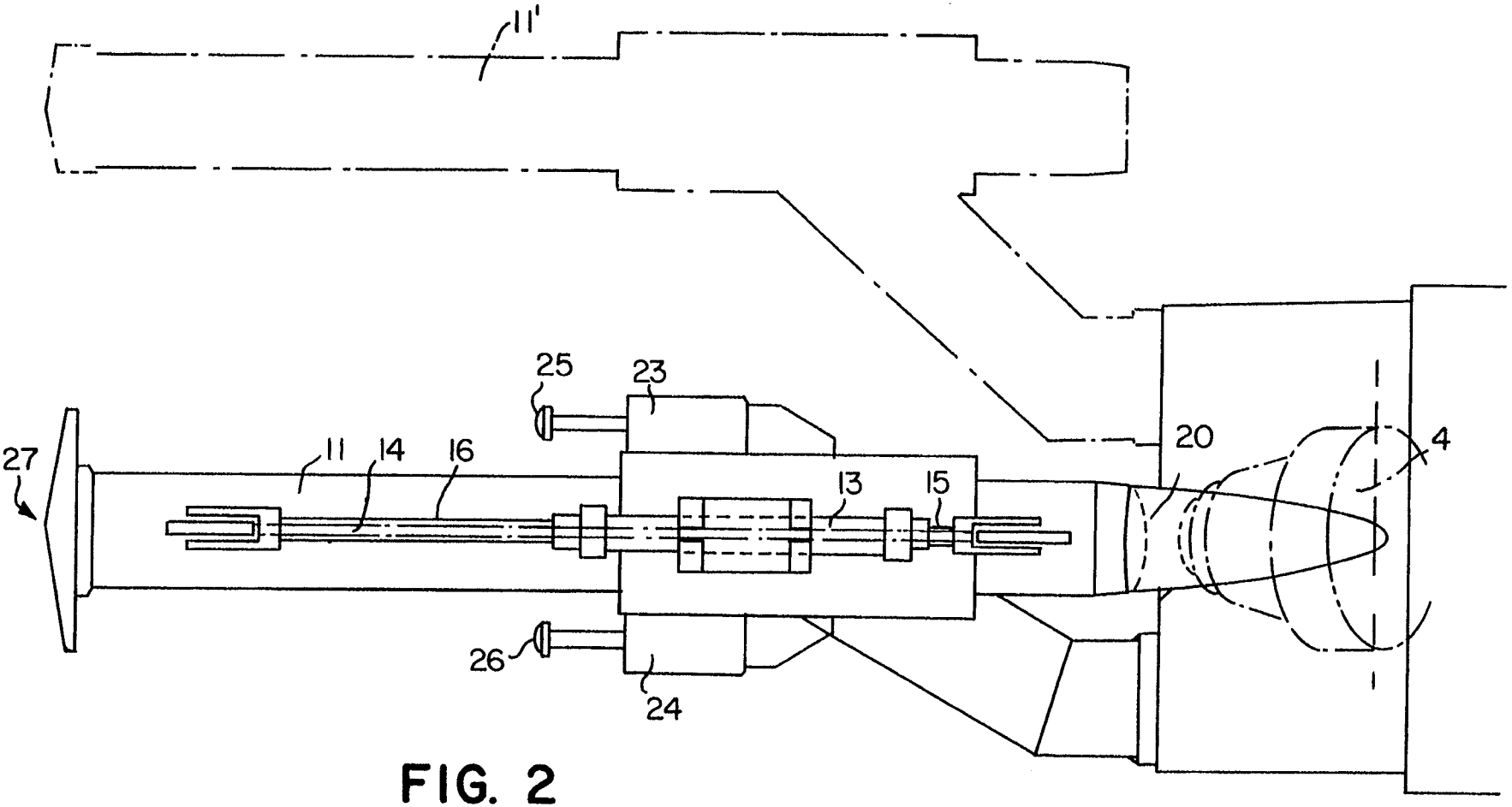
FIG. 2 shows a perpendicular view of FIG. 1.
Figure 3:
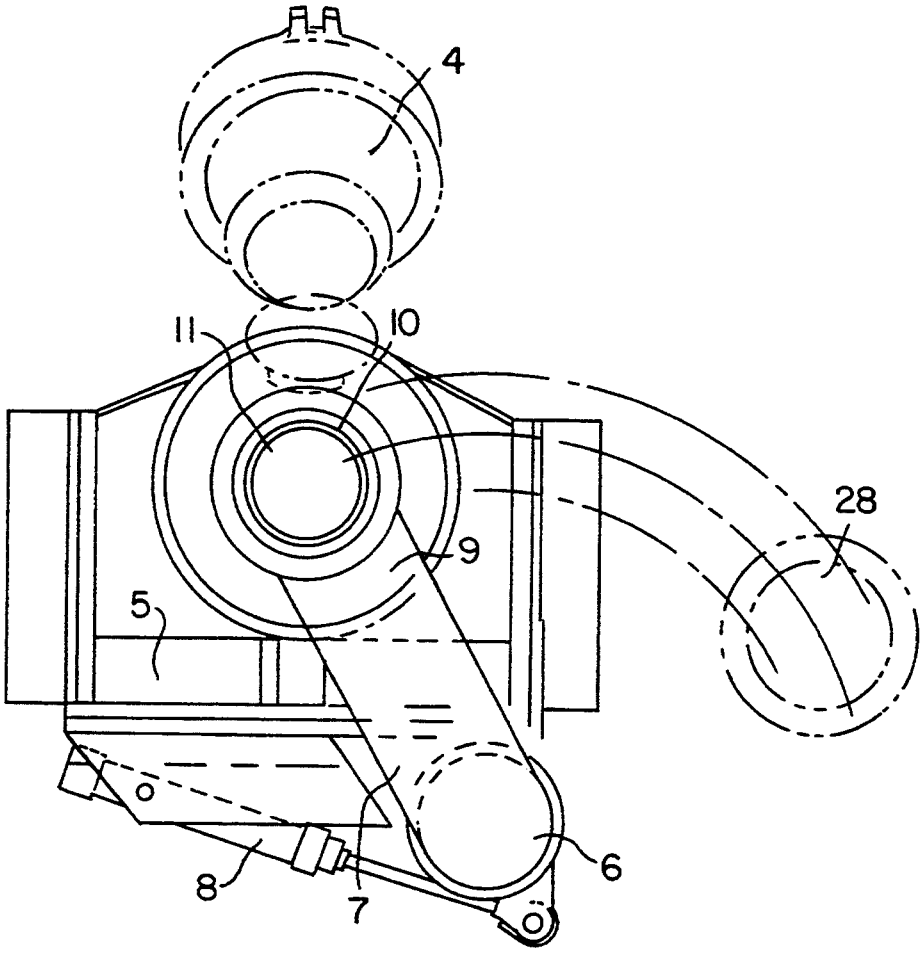
FIG. 3 shows an end view of FIG. 1.

In all Figures, the loading tube 11 is pivoted into the ramming position, that is in register with and axially centered about the main axis of the gun barrel 1, but in FIG. 3 these is also a ghosted masking 28 for the outward pivoting of the loading tube 11 beside the gun barrel. This position is intended to be utilized on replenishment or reloading of the loading tube. In FIG. 2, a second loading tube 11' suspended on a pendulum arm is indicated by ghosted lines, this tube being in its outwardly pivoted replenishment position.

In the starting position, the loading tube 11 is outwardly pivoted about its pivot arm 7 to the position 28 shown in FIG. 3. There, the loading tube is filled or loaded with a propellant charge 21 and the shell 20. The shell 20 is moved in so that its rear plane abuts against the collapsible tooth 18. Between the propellant charge 21 and the shell 20 there is a slight clearance a in this position. If, instead, the twin loading tube 11' had been utilized, the position would have been identical even if the loading tube would, on replenishment, have been located on the opposite side of the gun barrel 1.

After replenishment, the loading tube 11 is pivoted by the hydraulic ram 8 in so that it is centered axially about the main axis of the gun barrel 1. Thereafter, the hydraulic ram 13 is activated which, with the aid of its chain transmission, 20 accelerates the loading tube 11 in a direction towards the breech opening 2. During the acceleration, the rear plane of the shell abuts against the tooth 18 and the rear plane of the propellant charge against the bottom of the loading tube 11. When the buffer abutment 22 reaches the abutments 25, 26 of the hydraulic dampers 23, 24, the movement of the loading tube begins to be retarded. This takes place rapidly and in a very short distance of travel. The shell 20 and the propellant charge 21 which lies more or less loosely in the loading tube continue, however, in the original direction of movement, and thereby also into the respective ramming positions in the gun barrel.

The ramming force and speed can be governed by selection of that velocity to which the loading tube is accelerated and the rapidity with which the tube is retarded.

The movement of the loading tube continues until its muzzle enters the ramming position of the gun barrel. This imparts to both shell and propellant charge an adequate guiding throughout the entire ramming procedure.

When the shell leaves the loading tube 11, the tooth 18 is flipped out so that the propellant charge may pass. Given that the bottom of the loading tube has been provided with the ventilation apertures 27, the formation of a rearward suction is avoided which might otherwise have prevented the relatively light-weight propellant charge from following after the shell into its ramming position. In order to prevent the propellant charge from bouncing out again off the air cushion which is formed between shell and propellant charge, the ramming position of the charge should be provided with a locking device which grasps hold of the charge.

As soon as the shell and propellant charge have been rammed home, the screw or breech block 4 is closed and the gun is ready to open fire, while the loading tube is retracted to its outer, replenishment position. Since the retardation of the loading tube is so rapid and the hydraulic same unit 12 is simultaneously zeroed, the loading tube will rapidly be recuperated to its starting position.

As will be apparent from the above disclosure, the present invention provides an extremely rapid reloading of the piece and consequential fire rate, specially if the piece is provided with two pendulum-suspended loading tubes.

Replenishment of the loading tube may be effected from a magazine of the revolver type, from belt conveyors or the like.

The present invention should not be considered as restricted to the example described above and shown in the Drawings, this is but one conceivable alternative within the inventive concept as herein disclosed and hereinafter claimed.

What we claim and desire to secure by Letters Patent is:

1. A method for rapidly ramming ammunition units with at least one separate shell and propellant charge, said method including the steps of:

placing said propellant charge behind said shell in a loading carrier;

bringing said loading carrier into alignment with a breech opening of an artillery piece and centering said loading carrier on a main axis of a barrel of said artillery piece;

accelerating said loading carrier with said shell and said propellant charge positioned therein and being separate from each other, up to a predetermined ramming velocity towards the breech opening of said artillery piece;

rapidly retarding said loading carrier to a stationary position while said shell and said propellant charge are allowed to continue movement into their ramming positions in said artillery piece.

2. A method according to claim 1 further including the step of separately supporting said shell and said propellant charge in their respective separate positions in said loading carrier during an acceleration phase by supporting means provided in said loading carrier.

3. A method according to claim 2 wherein said acceleration phase ends and a retardation phase begins after said loading tube has entered a periphery of a chamber of the barrel.

4. A method according to claim 1 wherein said loading carrier comprises a loading tube and said shell and said propellant charge are supported in said loading tube by means abutting against their respective rear planes.

5. An apparatus for rapid simultaneous ramming of at least one shell and propellant charge into an artillery piece comprising:

a loading carrier designated for containing therein said propellant charge and said shell separately from each other;

means for bringing said loading carrier in alignment with a breech opening of said artillery piece;

means for displacing and accelerating said loading carrier with said propellant charge and said shell positioned therein up to a predetermined ramming velocity towards the breech opening of said artillery piece; and means for rapidly retarding said loading carrier to a stationary position while said shell and said propellant charge are allowed to continue movement into their ramming positions in said artillery piece.

6. An apparatus according to claim 5 wherein said shell and said propellant charge are supported separately during acceleration by supporting means provided in said loading carrier.

7. An apparatus according to claim 6 wherein said supporting means abut against respective rear ends of said shell and said propellant charge.

8. An apparatus according to claim 7 wherein said loading carrier is a loading tube and wherein said supporting means includes a collapsible heel provided in said loading tube for abutting against a rear plane of said shell during acceleration of said loading tube.

9. An apparatus according to claim 6 wherein said supporting means further includes a rear plane of said carrier against which the rear plane of said propellant charge abuts during acceleration, said rear plane being provided with ventilation apertures for preventing formation of a rear suction behind said propellant charge during acceleration.

10. An apparatus according to claim 5 wherein said loading carrier is a loading tube and said retarding means is actuated substantially when said loading tube reaches an entry region of a chamber of said artillery piece.

11. An apparatus according to claim 5 wherein said means for acceleration and displacement of said loading carrier includes a cradle in which said loading carrier is displacably positioned and a chain transmission hydraulic ram for acceleration of said loading carrier.

12. An apparatus according to claim 11 wherein said means for alignment of said loading carrier with the breech opening of said artillery piece includes a pivotable arm from which said cradle and carrier are pendulum suspended and pivotable between a first position beside said artillery piece and a second ramming position with said loading carrier axially centered with a main axis of said artillery piece.

13. An apparatus according to claim 5 wherein said means for rapidly retarding said loading carrier to said stationary position includes at least one hydraulic damper.

* * * * *